US011214466B2

(12) United States Patent
Bogli et al.

(10) Patent No.: US 11,214,466 B2
(45) Date of Patent: Jan. 4, 2022

(54) MONITORING SYSTEMS FOR PASSENGER CONVEYORS

(71) Applicant: Otis Elevator Company, Farmington, CT (US)

(72) Inventors: Craig Drew Bogli, Avon, CT (US); Tadeusz Pawel Witczak, Farmington, CT (US); Nikola Trcka, West Hartford, CT (US); Philipp Schedl, Vienna (AT); Robert Takacs, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/953,223

(22) Filed: Nov. 19, 2020

(65) Prior Publication Data

US 2021/0276833 A1 Sep. 9, 2021

(30) Foreign Application Priority Data

Mar. 9, 2020 (EP) ..... 20161811

(51) Int. Cl.
*B66B 29/00* (2006.01)
*B66B 23/12* (2006.01)
(Continued)

(52) U.S. Cl.
CPC ..... *B66B 29/005* (2013.01); *B66B 21/02* (2013.01); *B66B 23/12* (2013.01); *B66B 25/00* (2013.01)

(58) Field of Classification Search
CPC ..... B66B 29/00; B66B 29/005; B66B 21/02; B66B 23/12; B66B 25/00; B66B 25/003; B66B 25/006
(Continued)

(56) References Cited

U.S. PATENT DOCUMENTS 5,099,977 A * 3/1992 Hirose ..... B66B 23/02 198/323
8,727,095 B2 * 5/2014 Trojer ..... B66B 29/005 198/323
(Continued)

FOREIGN PATENT DOCUMENTS

JP 2007008709 A 1/2007
JP 2011105434 A 6/2011

OTHER PUBLICATIONS

European Search Report for Application 20161811.3; dated Nov. 2, 2020; 7 Pages.

*Primary Examiner* — James R Bidwell
(74) *Attorney, Agent, or Firm* — Cantor Colburn LLP

(57) ABSTRACT

A monitoring system for a passenger conveyor including: at least one acceleration sensor provided on a movable component of the passenger conveyor, wherein the moveable component moves in a closed loop path (P) when the passenger conveyor is in use; a fault detection sensor associated with the or each acceleration sensor and configured to provide data indicative of a fault in the moveable component. The monitoring system includes a controller configured to: receive data from the or each acceleration sensor; monitor a gravity vector (V) of the or each acceleration sensor; determine a direction of travel of the or each acceleration sensor; determine a current location of the or each acceleration sensor based on the monitored gravity vector (V) and the determined direction of travel; detect a fault from the data received from the or each fault detection sensor; identify a location of the detected fault.

13 Claims, 11 Drawing Sheets

(51) Int. Cl.
*B66B 21/02* (2006.01)
*B66B 25/00* (2006.01)

(58) Field of Classification Search
USPC ..... 198/322, 323
See application file for complete search history.

(56) References Cited

U.S. PATENT DOCUMENTS

| | | | | |
|---|---|---|---|---|
| 10,669,121 | B2 * | 6/2020 | Bogli | B66B 5/0012 |
| 2011/0106490 | A1 | 5/2011 | Idemori et al. | |
| 2012/0103756 | A1 * | 5/2012 | Braasch | B66B 25/006 198/323 |
| 2018/0029838 | A1 * | 2/2018 | Fang | B66B 25/003 |
| 2021/0139288 | A1 * | 5/2021 | Pahlke | B66B 23/24 |

* cited by examiner

MONITORING SYSTEMS FOR PASSENGER CONVEYORS

FOREIGN PRIORITY

This application claims priority to European Patent Application No. 20161811.3, filed Mar. 9, 2020, and all the benefits accruing therefrom under 35 U.S.C. § 119, the contents of which in its entirety are herein incorporated by reference.

TECHNICAL FIELD

This disclosure relates to monitoring systems for passenger conveyors, such as escalators or moving walkways, and methods for monitoring passenger conveyors.

BACKGROUND

Conventional passenger conveyors, such as escalators and moving walkways, generally comprise a transportation band, on which passengers stand, which is propelled by a drive system to convey the passengers from one place to another place, for example between floors of a building or along extended distances.

The transportation band comprises a plurality of conveyance elements, such as steps or pallets, which are drivingly coupled to at least one drive member, such as a drive belt. The drive belt moves along a conveyance path, around a first turnaround portion, returns inside a balustrade (or associated support structure) following a return path and then around a second turnaround portion. A drive pulley, driven by a drive motor, is generally provided at one of the turnaround portions to drive the drive belt.

Escalators transport passengers between a lower landing region and an upper landing region. Escalators typically comprise an endless transportation band formed from a plurality of mutually connected step bodies. The transportation band is mounted on a drive belt or chain belt, which is driven about an upper reversal point at the upper landing region and a lower reversal point at the lower landing region.

Moving walkways transport passengers between a first landing region and a second landing region. Moving walkways are typically pallet type moving walkways, which include a continuous series of pallets joined together to form a transportation band. Inclined moving walkways transport passengers over a vertical distance between a first/lower landing region and an upper/second landing region. Moving walkways can transport passengers over extended distances, and inclined sections can be provided within extended moving walkways.

Escalators and moving walkways are often provided with fault detection sensors which are configured to detect issues such as, but not limited to, friction, noise or component faults.

Condition Based Maintenance (CBM) is a form of predictive maintenance, in which sensor(s) are used to measure the operating conditions and/or status. Fault detection sensors produce data which can be collated and analysed to establish trends, predict failure, and calculate remaining operational life. It is known to use CBM techniques on escalators and moving walkways.

However, in all of these situations, it is difficult to accurately identify the location of a detected fault or issue.

SUMMARY

According to a first aspect of the present disclosure there is provided a monitoring system for a passenger conveyor comprising at least one acceleration sensor provided on a movable component of the passenger conveyor, wherein the moveable component moves in a closed loop path when the passenger conveyor is in use; a fault detection sensor associated with the or each acceleration sensor and configured to provide data indicative of a fault in the moveable component; and a controller configured to: receive data from the or each acceleration sensor; monitor a gravity vector of the or each acceleration sensor; determine a direction of travel of the or each acceleration sensor; determine a current location of the or each acceleration sensor based on the monitored gravity vector and the determined direction of travel; detect a fault from the data received from the or each fault detection sensor; identify a location of the detected fault based on the determined current location of the associated acceleration sensor.

The term moveable components refers to the components of passenger conveyors which travel in a closed loop path, for example but not limited to, conveyance elements, such as escalator steps or pallets, drive members, such as drive belts, and moving handrails.

The determined fault may be one or more of the following: wear, bearing failure, dirt, lack of lubrication, misalignment of components. The or each fault detection sensor may be integral with or adjacent to an associated acceleration sensor.

The at least acceleration sensor and the associated fault detection sensor may be provided on any component of the passenger conveyor which follows a closed loop path during normal operation of the passenger conveyor. The passenger conveyor may include a plurality of conveyance elements, at least one moving handrail and a drive member. At least one acceleration sensor and its associated fault detection sensor may be provided on one or more of: a conveyance element, the drive member or the/each moving handrail.

The controller may be configured to determine the current location of the acceleration sensor in relation to a plurality of predefined regions of the closed loop path.

The controller may be configured to determine the plurality of predefined regions of the closed loop path based on the monitored gravity vector.

At least one acceleration sensor may act as the associated fault detection sensor.

The or each acceleration sensor may be configured to detect vibrations or misalignment of the moveable component on which it is mounted. For example, when abnormal vibrations are detected on the transportation band, this is generally an indication of issues or problems with the operation, such as, but not limited to, wear, bearing failure, dirt, lack of lubrication, or step/pallet misalignment; when abnormal vibrations are detected on the moving handrail, this can be an indication of issues or problems with the operation, such as, but not limited to, sticking, dirt, or loss of pressing force; and when abnormal vibrations are detected on the drive belt, this can be an indication of issues or problems with the operation, such as, but not limited to, wear, bearing failure, dirt, or lack of lubrication.

The fault detection sensor may be provided adjacent to the associated acceleration sensor. At least one fault detection sensor may be a microphone. At least one fault detection sensor may be configured to detect vibration. At least one fault detection sensor may be configured to detect alignment and/or misalignment of the transportation band. At least one fault detection sensor may be a temperature sensor. At least one fault detection sensor may be an electrical current sensor.

The controller may be configured to monitor a start-up acceleration of the or each acceleration sensor. The controller may be configured to determine the direction of travel of the or each acceleration sensor based on the monitored start-up acceleration and the monitored gravity vector.

The controller may be configured to determine an orientation of the or each acceleration sensor after power up of the acceleration sensor.

The controller may be provided as a discrete unit provided at or near the elevator system. The controller may comprise a controller unit incorporated into the or each acceleration sensor.

The monitoring system may comprise a control station located remotely from the passenger conveyor. The controller may further be configured to transmit data to the control station. The control station may be integrated into a hand held device, such as a smart phone, tablet or laptop. The controller may be configured for wireless communication with the control station. The control station may be configured to transmit data to a hand held device, such as a smart phone, tablet or laptop. The control station may utilise the transmitted data to predict maintenance and/or repair schedules. The control station may be configured to transmit the maintenance and/or repair schedules to a remote user. The control station may use the transmitted data for condition based maintenance. The control station may produce an output related to maintenance and/or repair. The control station output may be transmitted to an operator, located remotely from the control station.

According to a further aspect, there is provided a passenger conveyor comprising a monitoring system as described above.

The passenger conveyor may be an escalator and the moveable component may be an escalator step.

The passenger conveyor may be an escalator. The passenger conveyor may be a moving walkway. The passenger conveyor may be an inclined moving walkway.

The moveable component may be a conveyance element, such as an escalator step or a pallet. The moveable component may be a drive member, such as a drive belt. Acceleration sensors and associated fault detection sensors may be provided on one or more of: a conveyance element, a plurality of conveyance elements, the moving handrail(s), the drive member (drive belt).

According to a further aspect, there is provided a method of monitoring a passenger conveyor, comprising: receiving data from an acceleration sensor provided on a moveable component of the passenger conveyor; determining a direction of travel of the acceleration sensor; monitoring a gravity vector of the acceleration sensor; determining a current location of the acceleration sensor based on the monitored gravity vector and the determined direction of travel; receiving data indicative of a fault in the moveable component; detecting a fault from the data received from the fault detection sensor; identifying a location of the detected fault based on the determined current location of the acceleration sensor.

The step of identifying a location of the detected fault may include determining the current location in relation to a plurality of predefined regions of the closed loop path.

The method may comprise a step of determining the plurality of predefined regions of the closed loop path based on the monitored gravity vector.

The step of receiving data indicative of a fault in the moveable component may include receiving data from the acceleration sensor.

The step of receiving data indicative of a fault in the moveable component may include receiving fault data from a fault detection sensor provided adjacent to the acceleration sensor.

The step of determining a direction of travel of the acceleration sensor may include: monitoring a start-up acceleration of the acceleration sensor; and determining the direction of travel based on the determined monitored start-up acceleration and the monitored gravity vector.

The method may comprise determining an orientation of the acceleration sensor after power up of the acceleration sensor.

The method may comprise transmitting data to a control station located remotely from the passenger conveyor.

The method may further comprise wired or wireless transmission of data to a remote location. The control station may use the transmitted data for condition based maintenance. The control station may produce an output related to maintenance and/or repair. The control station output may be transmitted to an operator, located remotely from the control station. The control station may transmit the maintenance and/or repair schedules to a remote device, such as a smart phone, tablet or laptop.

Features described in relation to the first aspect of the present disclosure may of course also be applied to the further aspects, and vice versa. In general, features of any example described herein may be applied wherever appropriate to any other example described herein. Where reference is made to different examples or sets of examples, it should be understood that these are not necessarily distinct but may overlap.

The system and method described are able to provide improved determination of the location of detected faults, which has clear advantages for operational monitoring and maintenance.

The monitoring system and monitoring method described can be used in Condition based Maintenance (CBM) processes to determine health level parameters of the passenger conveyor and predict maintenance and/or repair schedules. The monitoring system and monitoring method described can be used in conjunction with other known fault detection sensors provided on other components of the passenger conveyor.

DRAWING DESCRIPTION

Certain examples of the present disclosure will now be described with reference to the accompanying drawings in which.

Figure 2:
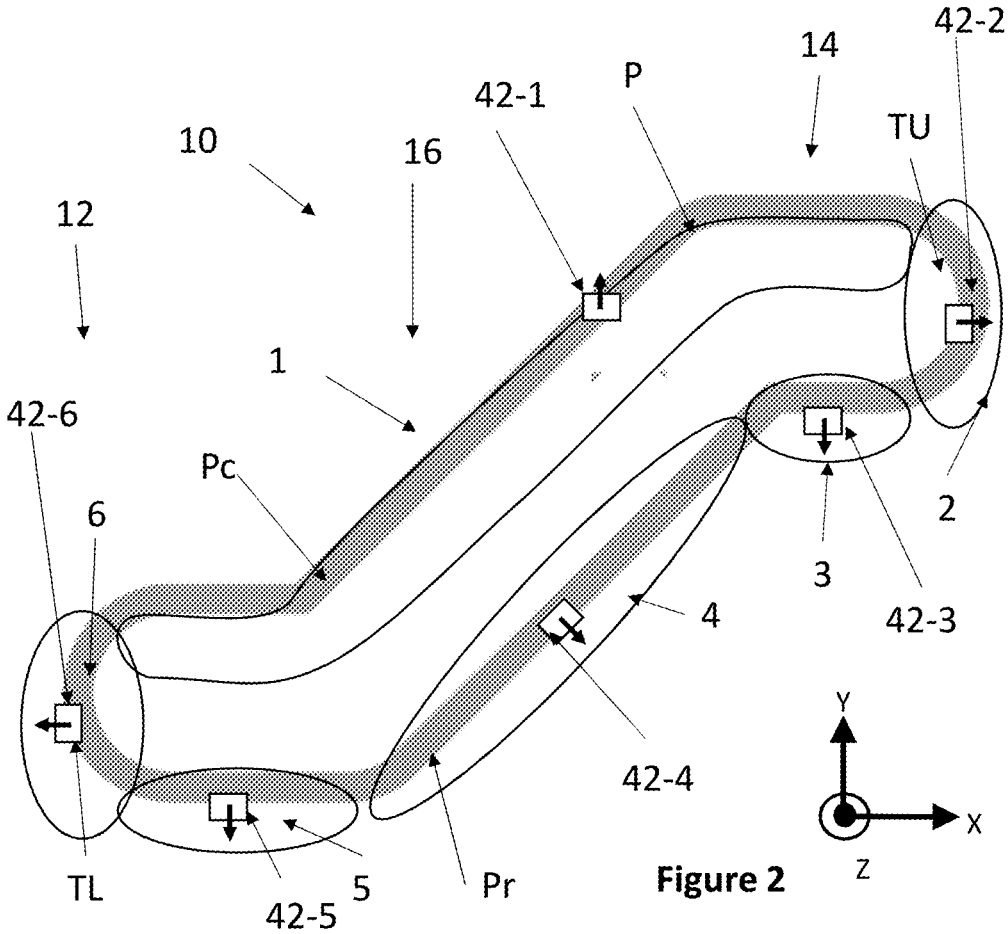
FIG. 2 shows a schematic representation of a moveable component of the passenger conveyor of FIG. 1.
Figure 4:
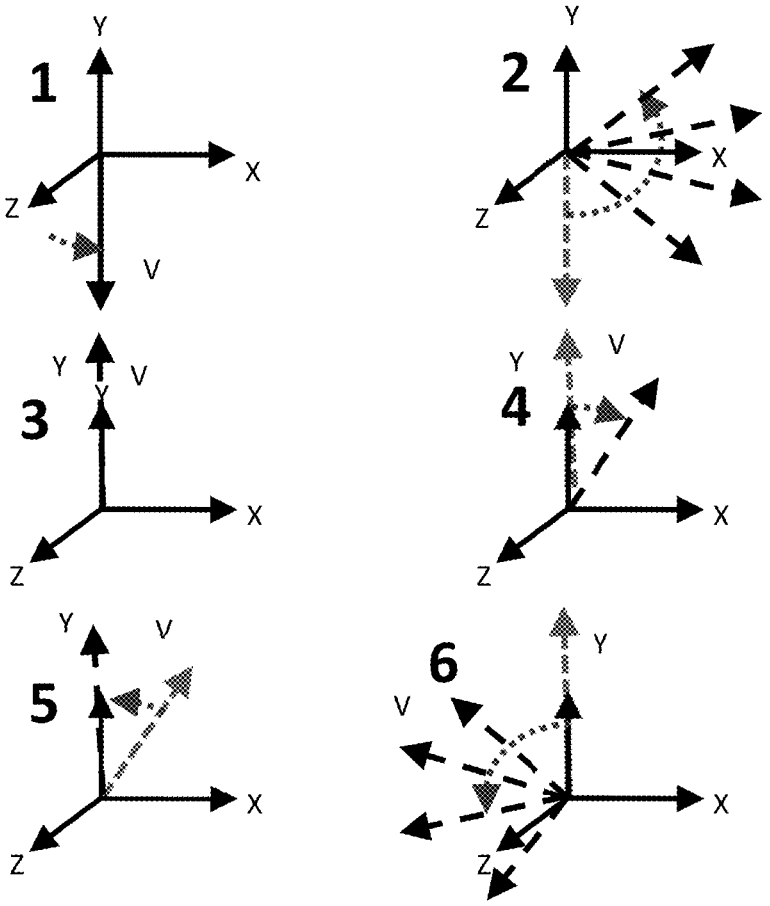
Figure 5:
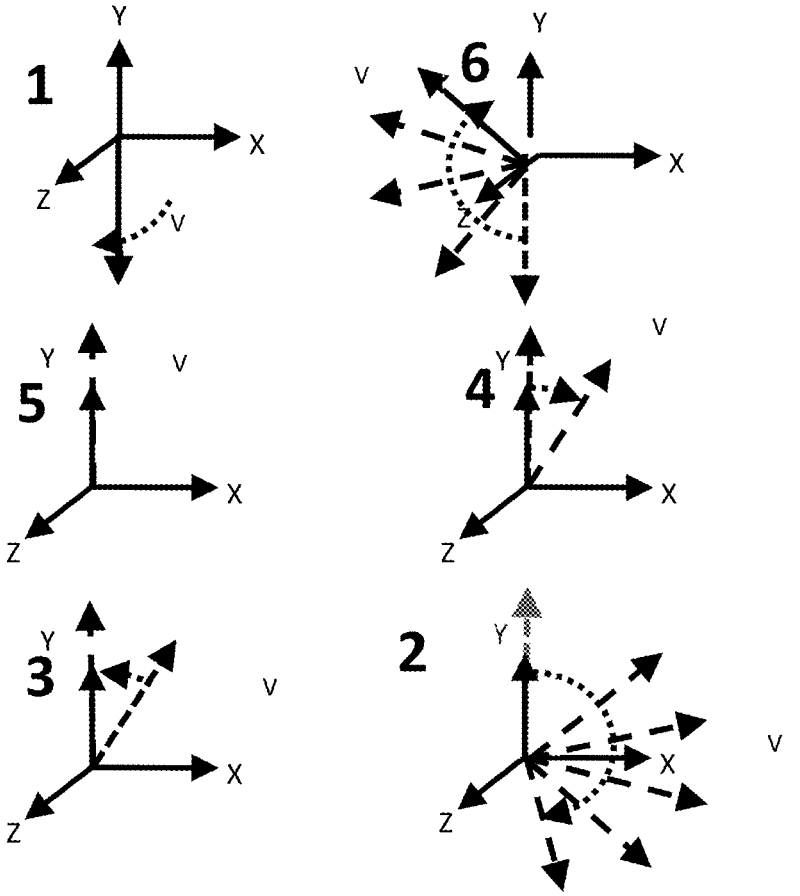
Figure 6:
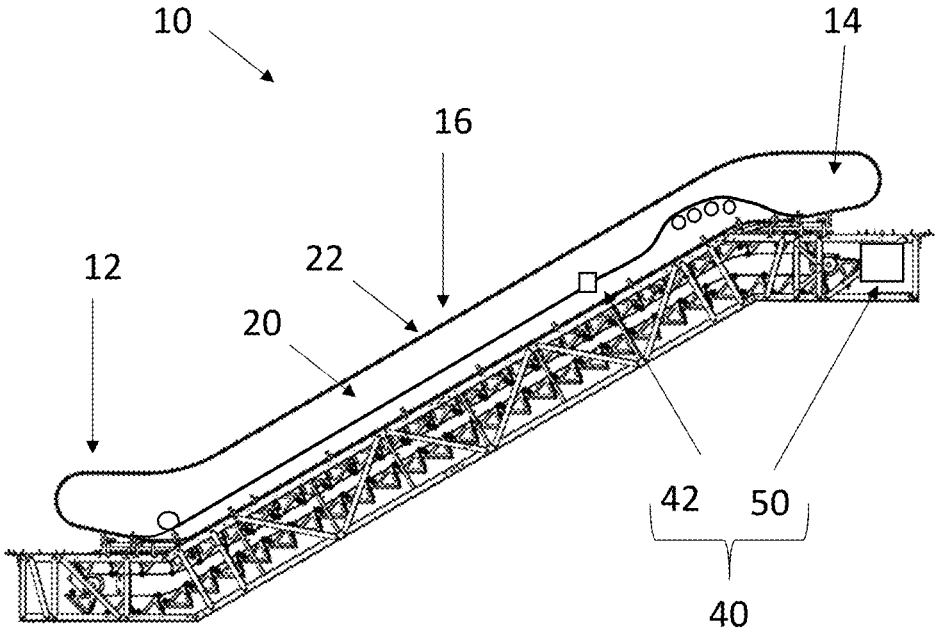
Figure 7:
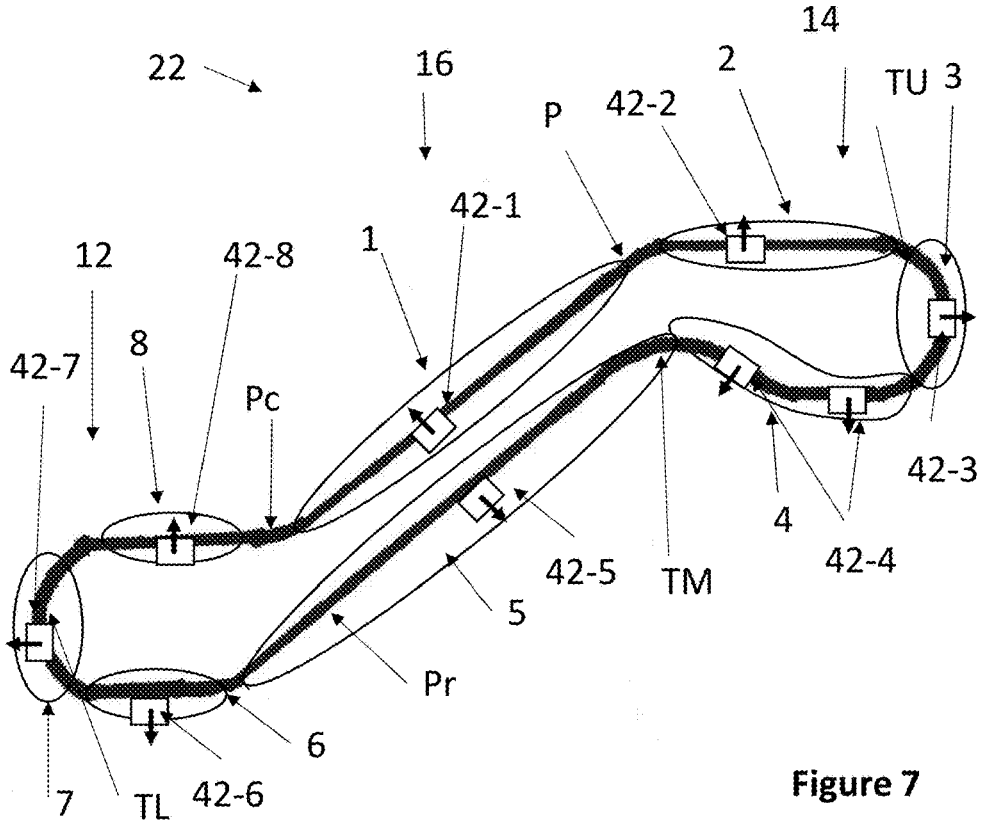
Figure 8:
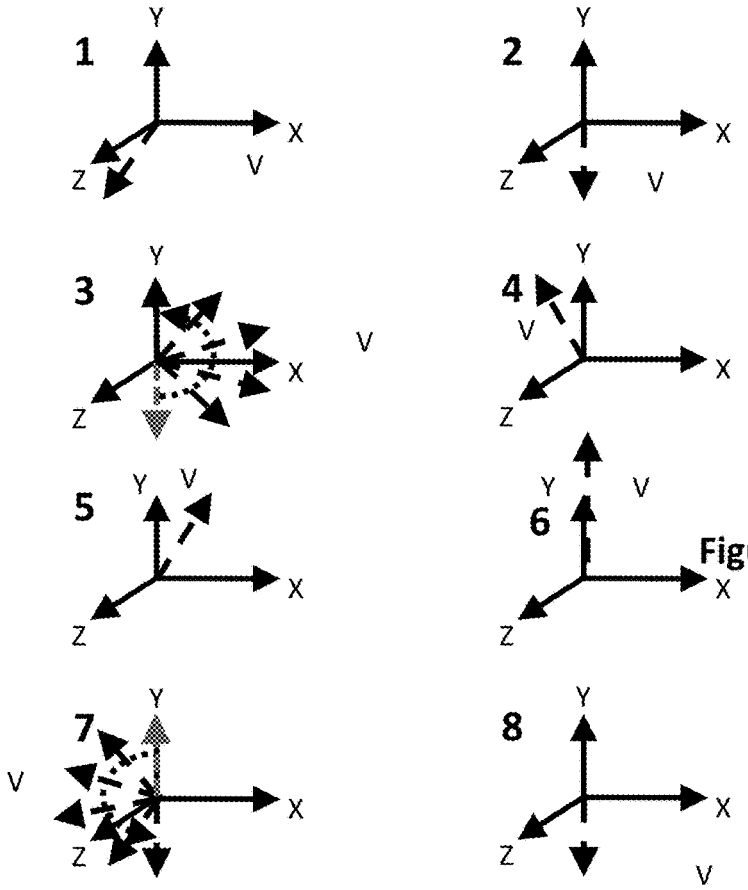
Figure 9:
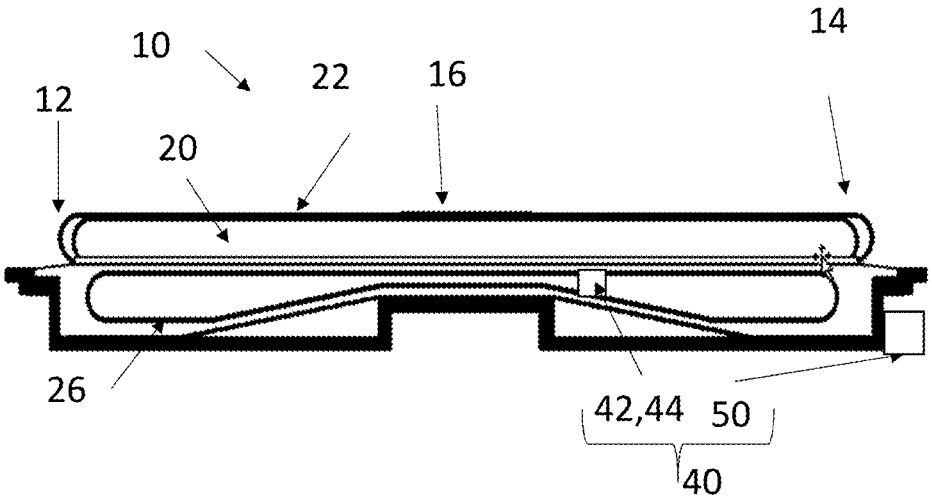
Figure 10:
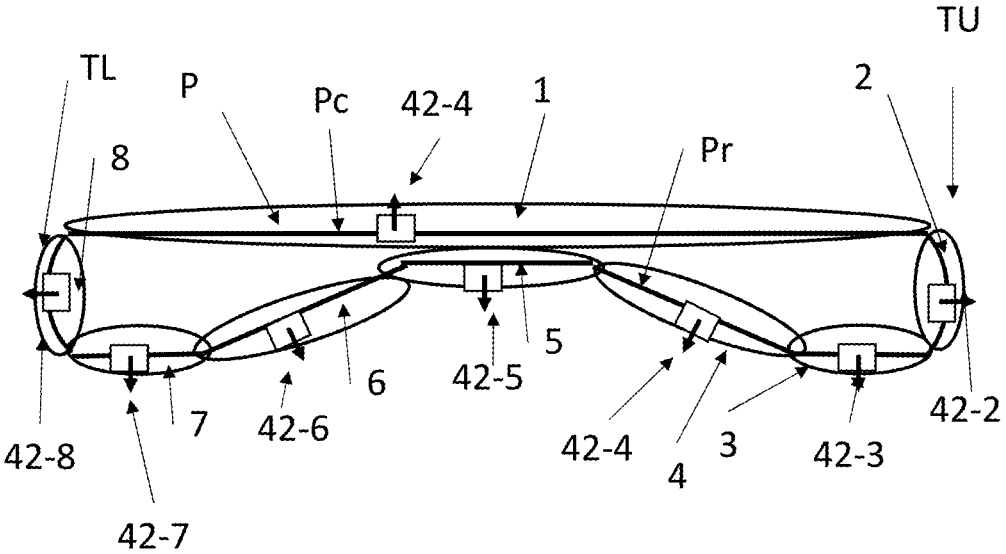
Figure 11:
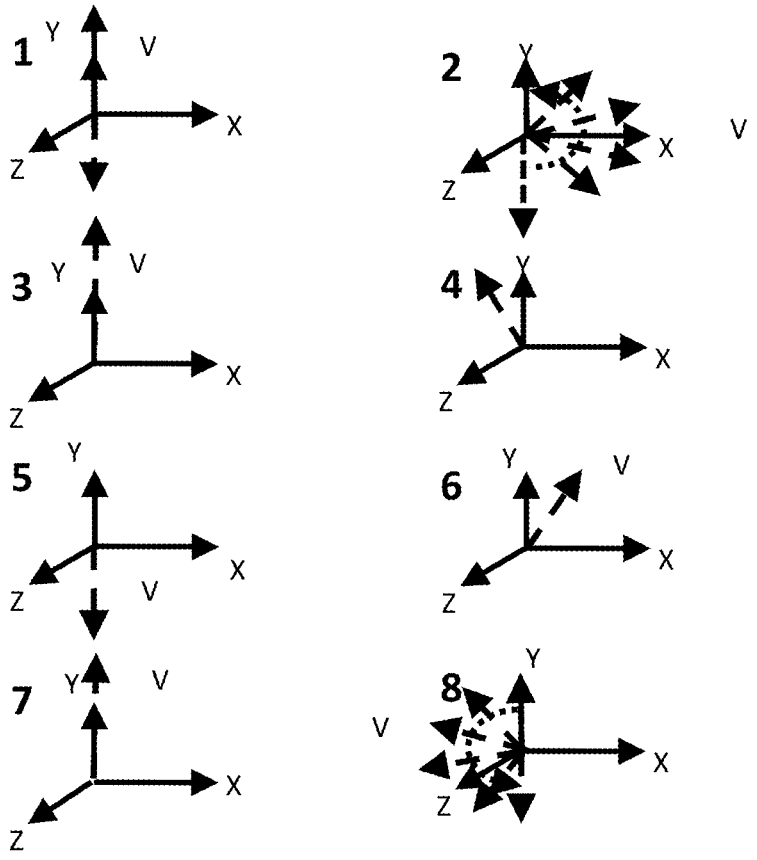
Figure 12:
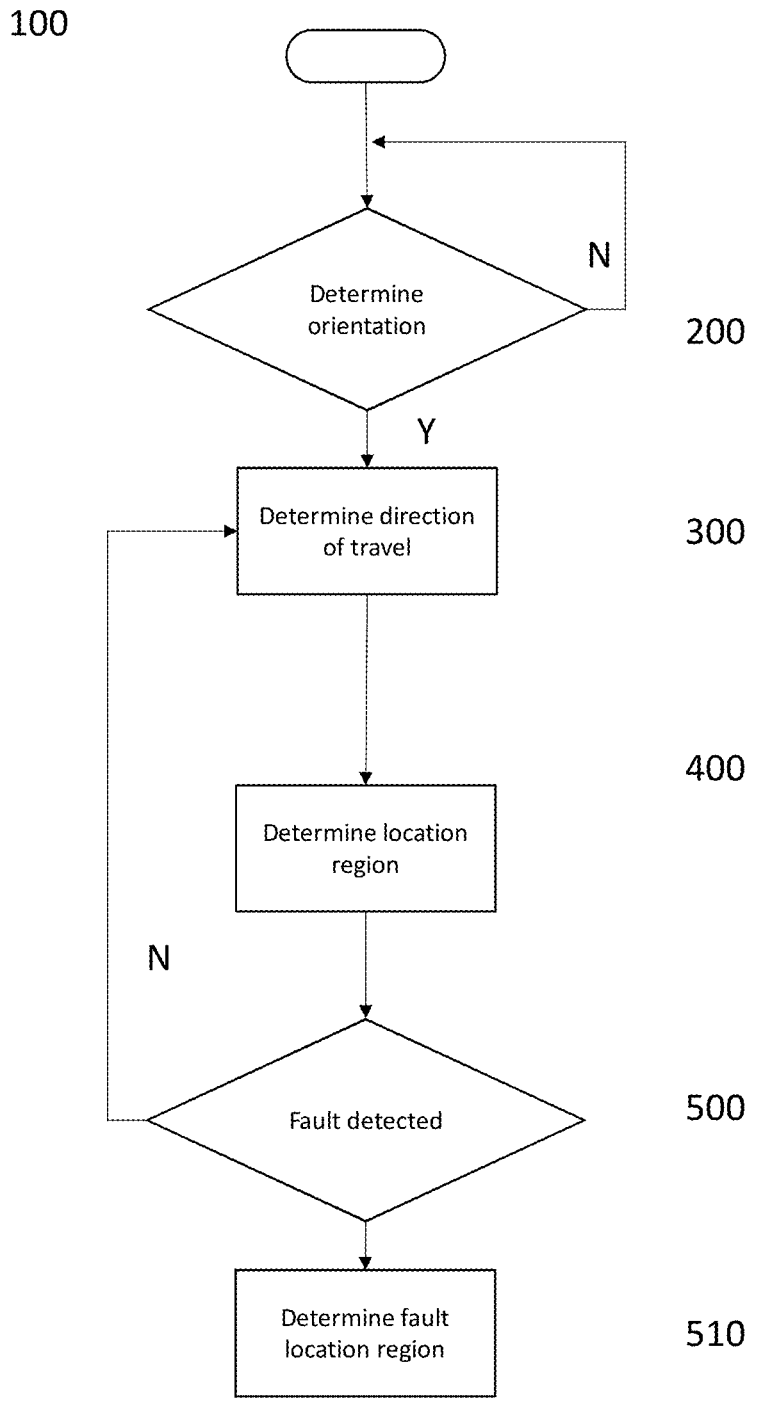
Figure 13:
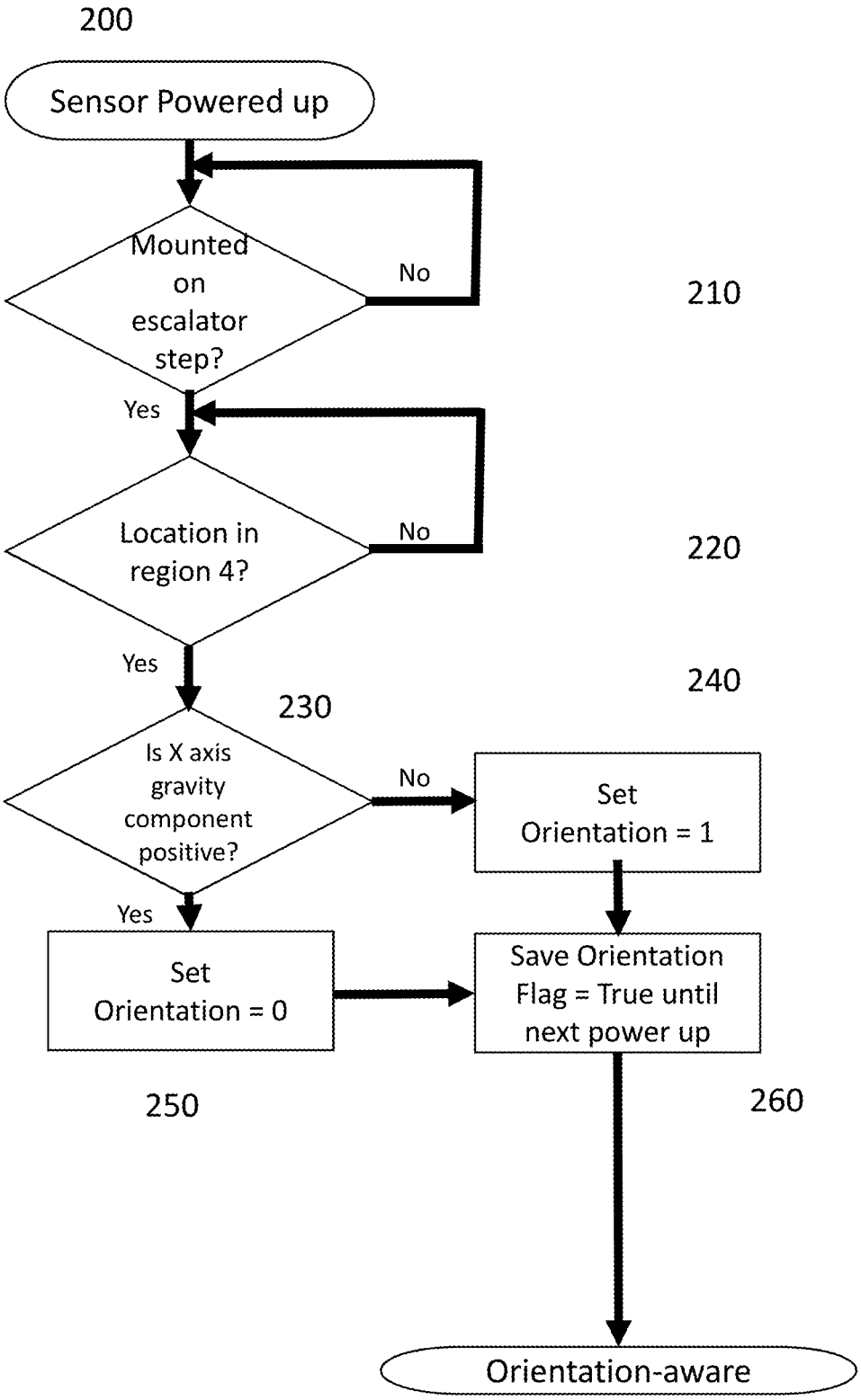
Figure 14A:
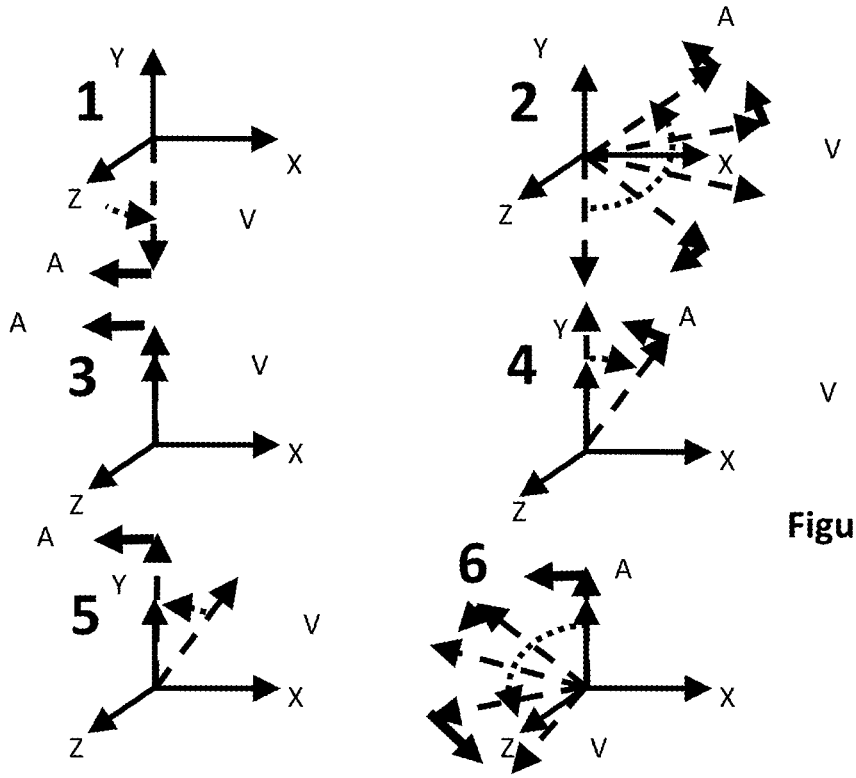
Figure 14B:
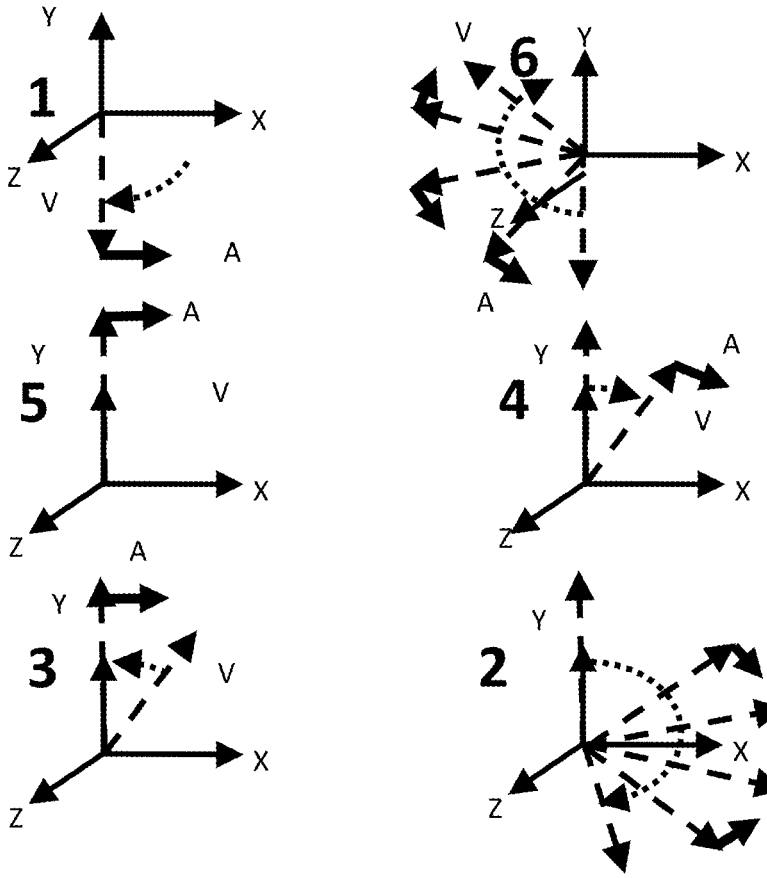
Figure 15:
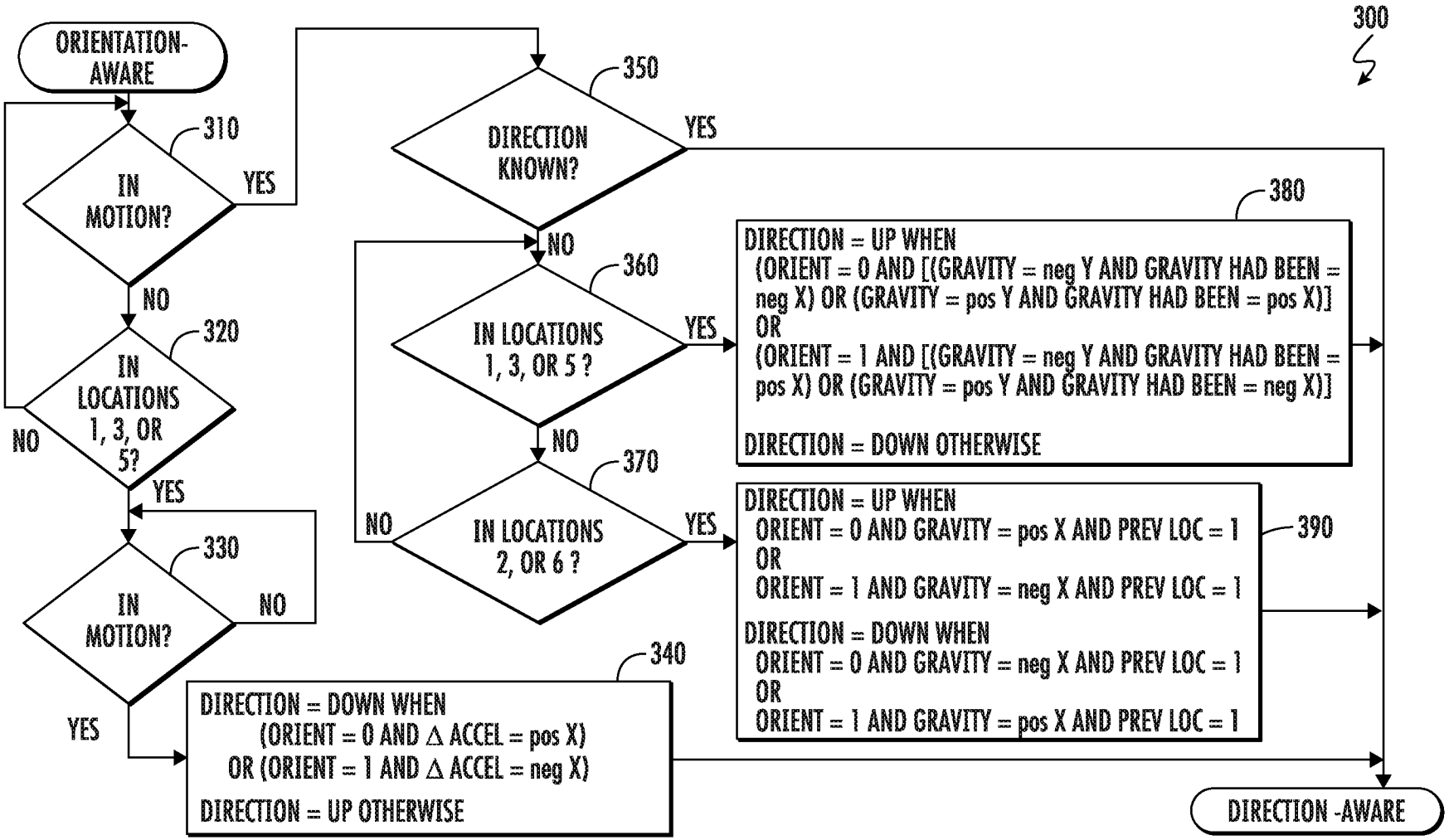
Figure 16:
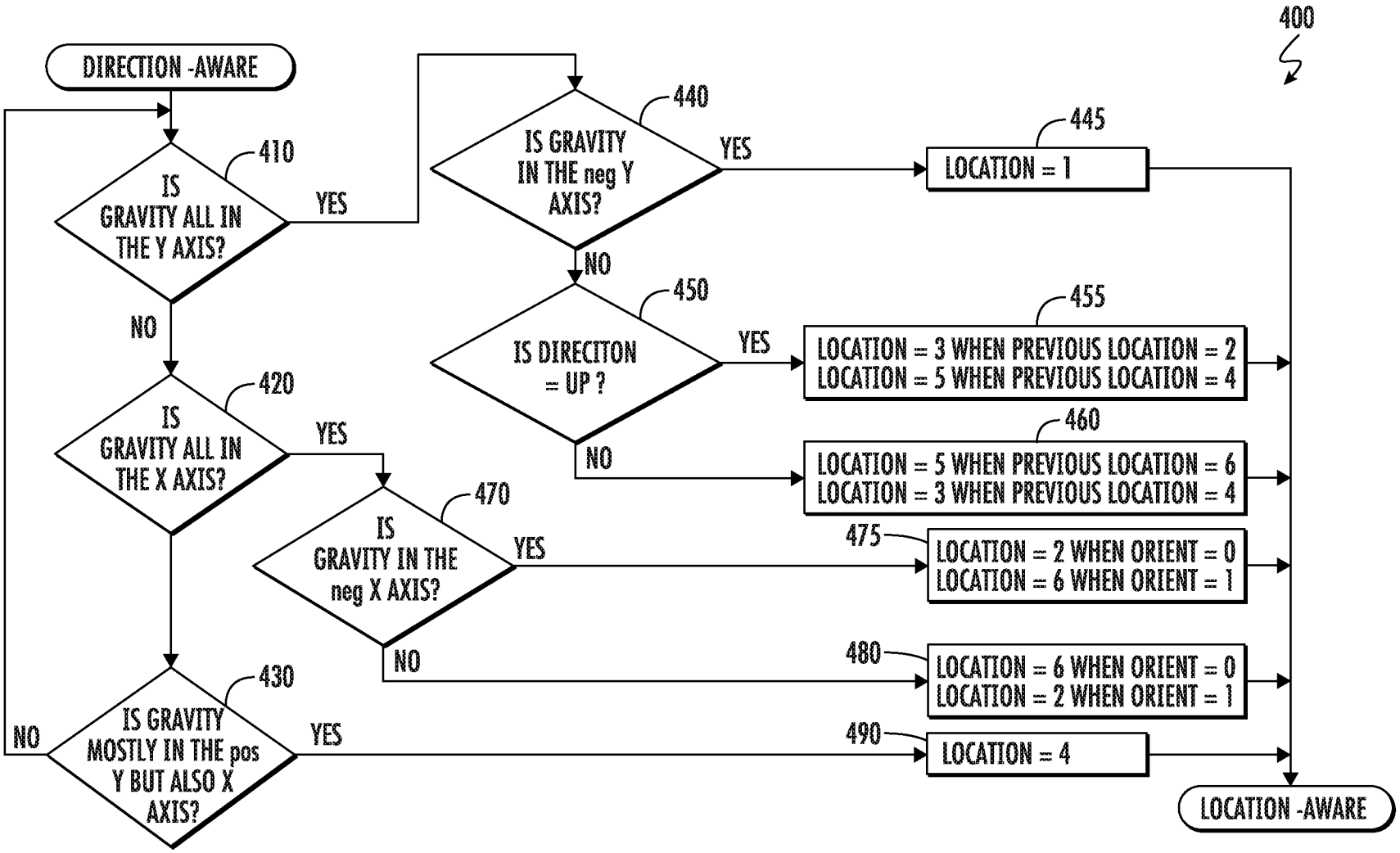

FIGS. 4 and 5 schematically represent the gravity vector variation with respect to FIG. 2;

FIG. 6 shows a passenger conveyor according to another example of the present disclosure;

FIG. 7 shows a schematic representation of a moveable component of the passenger conveyor of FIG. 6;

FIG. 8 schematically represents the gravity vector variation with respect to FIG. 7;

FIG. 9 shows a passenger conveyor according to another example of the present disclosure;

FIG. 10 shows a schematic representation of a moveable component of the passenger conveyor of FIG. 9;

FIG. 11 schematically represents the gravity vector variation with respect to FIG. 10;

FIG. 12 shows a schematic representation of an exemplary method of the present disclosure;

FIG. 13 is a schematic representation of an exemplary step for determining the orientation in the method of FIG. 12;

FIG. 14*a* and FIG. 14*b* is a schematic representation of an exemplary step for determining the direction of travel in the method of FIG. 12;

FIG. 15 schematically represent the step of FIG. 14 with respect to FIG. 2, and FIG. 16 is a schematic representation of an exemplary step for determining the location in the method of FIG. 12.

DETAILED DESCRIPTION

Figure 1:
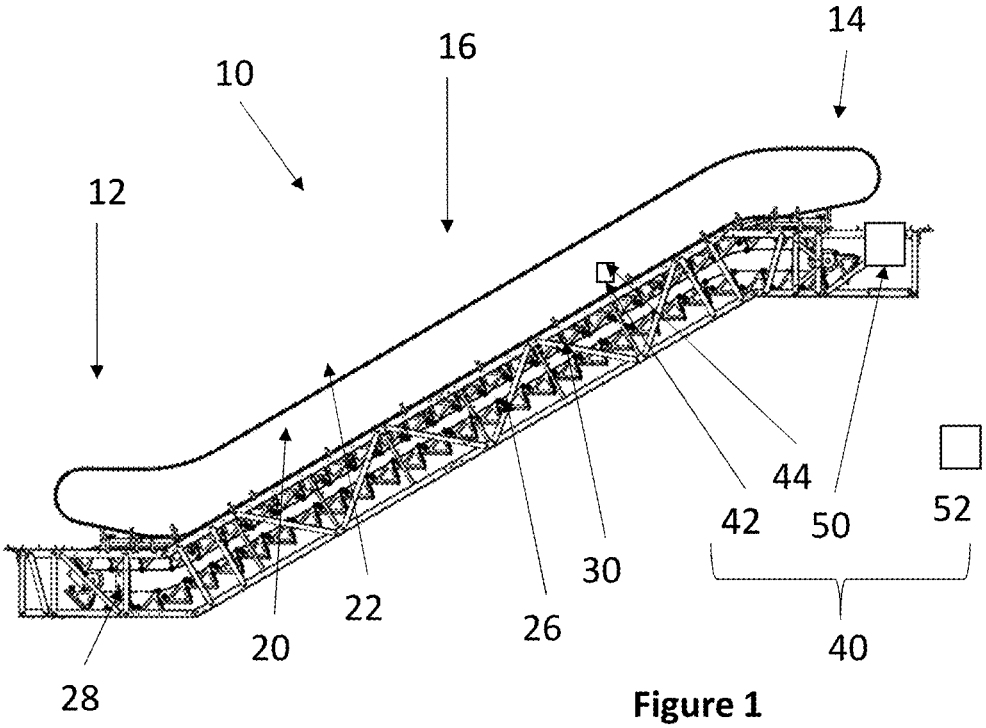
FIG. 1 shows a passenger conveyor according to an example of the present disclosure.

FIG. 1 shows a passenger conveyor 10, represented in this figure as an escalator, on which passengers are transported between a first landing region 12 and a second landing region 14. A truss 28 extends between the first landing region 12 (also referred to as a lower landing region) and the second landing region 14 (also referred to as an upper landing region). A central region 16, which in this case is an inclined region 16, extends between the first and second landing regions 12, 14.

Balustrades 20 which each support a moving handrail 22 extend along each side of the passenger conveyor 10. The passenger conveyor 10 comprises a plurality of conveyance elements 26 (escalator steps 26). The plurality of escalator steps 26 are mounted on a drive belt 30.

A passenger conveyor monitoring system 40 includes an acceleration sensor 42 provided on one of the escalator steps 26 (conveyance elements 26), a fault detection sensor 44 and a controller 50. In this example, the acceleration sensor 42 acts as the fault detection sensor 44. However, a separate fault detection sensor 44 could be provided adjacent to the acceleration sensor 42. The sensors 42, 44 are configured for wireless communication with the controller 50.

The acceleration sensor 42 is a three axis accelerometer which is configured to measure the amount of acceleration due to gravity, from which the angle it is tilted with respect to a given reference can be determined. During the initial movement of the acceleration sensor 42, there is an acceleration force due to the start-up motion of the escalator step 26 (conveyance element 26). However, this is small in comparison to the measured acceleration due to gravity.

The controller 50 is configured for wireless communication with a control station 52, located remotely from the passenger conveyor 10. For example, the controller 50 can be configured to electrically communicate with a cloud computing network via a network interface device. The network interface device includes any communication device (e.g., a modem, wireless network adapter, etc.) that operates according to a network protocol (e.g., Wi-Fi, Ethernet, satellite, cable communications, etc.) which establishes a wired and/or wireless communication with a cloud computing network.

In passenger conveyors 10, moveable components, such as conveyance elements 26 (escalator steps 26), moving handrails 22 and drive belts 30, move along defined closed loop paths P.

FIG. 2 shows a schematic representation of a closed loop path P of a moveable component of an inclined passenger conveyor 10, in this case an escalator step 26 of an escalator 10 as shown in FIG. 1. An acceleration sensor 42 is mounted on the escalator step 26. The closed loop path P includes a conveyance path (upper portion) Pc, and a return path (lower portion) Pr. When the escalator 10 is in operation, the escalator step 26 and the acceleration sensor 42 move around the closed loop path P. FIG. 2 shows six regions 1, 2, 3, 4, 5, 6 defined in the closed loop path P. A first region 1 corresponds to the portion of the conveyance path Pc in which the escalator step 26 transports a passenger. A second region 2 is around an upper turning point TU. A third region 3 is in the upper landing area 14 of the return path Pr. A fourth region 4 is in the inclined region 16 of the return path Pr. A fifth region 5 is in the lower landing area 12 of the return path Pr; and a sixth region 6 is around a lower turning point TL.

In region 1, the escalator step 26 moves horizontally and upwards, meaning that the acceleration sensor 42 is oriented with its "right side" upwards (shown with an arrow).

Figure 3:
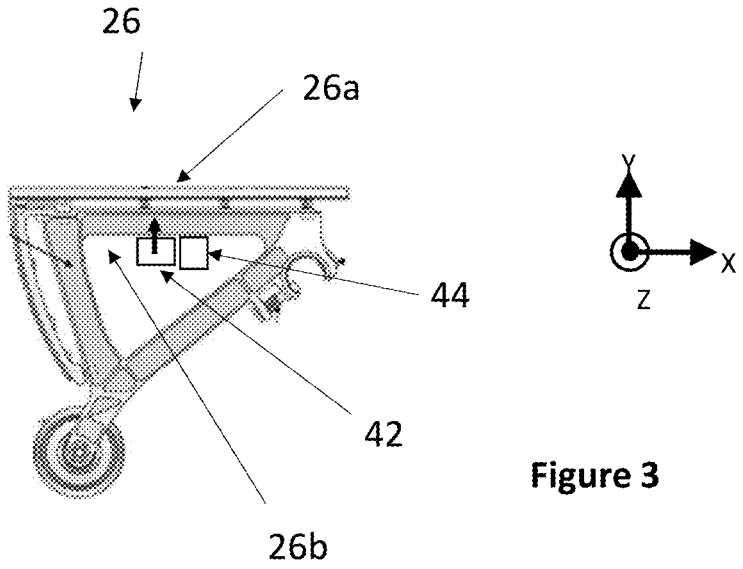
FIG. 3 shows an exemplary conveyance element of FIG. 1.

FIG. 3 shows the orientation of an escalator step 26 of FIG. 1 as it moves through region 1 of FIG. 2. The escalator step 26 includes a passenger surface 26*a* on which a passenger stands which is substantially horizontal in this orientation (i.e. in region 1). The acceleration sensor 42 is mounted on an underside 26*b* of the escalator step 26. However, it will be appreciated that the acceleration sensor 42 can be mounted in any convenient location on the escalator step 26. In this example, a separate fault detection sensor 44 is provided adjacent to the acceleration sensor 42. The fault detection sensor 44 could be any sensor used within passenger conveyors for detecting faults, for example but not limited to, for detecting vibration; alignment and/or misalignment of the escalator step 26; temperature, or electrical current. In region 1, the escalator step 26 moves horizontally and upwards with the passenger surface 26*a* facing upwards, meaning that the acceleration sensor 42 is oriented with its "right side" upwards (shown with an arrow).

Referring back to FIG. 2, as the escalator step 26 moves along the closed loop path P, its orientation changes. Since the acceleration sensor 42 is mounted to the escalator step 26 its orientation also changes. In other words, the acceleration sensor 42 tilts with respect to x, y and z axes, where the y axis is a vertical axis, and the x axis and z axis are horizontal axes.

Orientation of the acceleration sensor 42 in each region 1, 2, 3, 4, 5, 6, is schematically represented by references 42-1, 42-2, 42-3, 42-4, 42-5, 42-6. The acceleration due to gravity acting on the acceleration sensor 42, referred to as a gravity vector V, can be monitored in the x, y and z axes.

FIG. 4 shows the acceleration due to gravity acting upon the acceleration sensor 42, i.e. the gravity vector V, in each region of the closed loop path P of FIG. 2. As the passenger conveyor 10 travels upwards, the acceleration sensor 42 moves in a clockwise direction around the closed loop path P, starting in region 1 and moving through regions 2, 3, 4, 5, 6 then back to 1. As the acceleration sensor 42 moves along the closed loop path P and its orientation changes, the acceleration due to gravity acting on the acceleration sensor 42, i.e. the gravity vector V (shown with dashed lines) varies in the x, y and z axes. The grey arrow shows the gravity vector V at the start of a region, and the variation of the gravity vector V within each region is represented with a dotted line.

In region 1, the escalator step 26 moves horizontally and upwards with the passenger surface 26*a* facing upwards, meaning that the acceleration sensor 42-1 is oriented with its "right side" upwards, so it detects a negative gravitational acceleration in the y direction. In region 2, the escalator step 26 moves around the upper turning point TU and the gravity vector V varies as the orientation of the acceleration sensor 42-2 changes. At a mid-point of region 2 (shown in FIG. 4) the acceleration sensor 42-2 has rotated approximately ninety degrees. In region 3, the escalator step 26 moves horizontally with the passenger surface 26*a* facing down, meaning that the acceleration sensor 42-3 is oriented upside down, so it detects a positive gravitational acceleration in the y axis. In region 4, the escalator step 26 moves along the inclined portion of the return path Pr, and the acceleration sensor 42-4 remains upside down. In region 5, the escalator step 26 moves horizontally again with the passenger surface 26*a* facing down and the acceleration sensor 42-5 upside down. In region 6, the escalator step 26 moves around the lower turning point TL and the gravity vector V varies as the orientation of the acceleration sensor 42-6 changes.

FIG. 5 shows the acceleration due to gravity acting upon the acceleration sensor 42, i.e. the gravity vector V, in each region of the closed loop path P of FIG. 2 as the passenger conveyor 10 moves downwards, The acceleration sensor 42 moves in an anti-clockwise direction around the closed loop path P, starting in region 1 and moving through regions 6, 5, 4, 3, 2, and then back to region 1.

There is no differentiation in the gravity vector V in regions 1, 3, 4 & 5 between the upwards and downwards travel of the passenger conveyor (in motion) as well as stationary (no motion). Variation or progression of the gravity vector V as the acceleration sensor 42 moves through regions 2 and 6 is the only difference i.e. increasing or decreasing angle in XY plane.

When the passenger conveyor 10 is in normal operation, the moveable components including the escalator step 26 move at a constant speed in regions 1 and 4. The acceleration sensor 42 can detect this from analysis of sensed vibrations. When the passenger conveyor 10 is not in motion, the acceleration due to gravity acting on the acceleration sensor 42, i.e. the gravity vector V, in regions 1 and 4 is clearly identifiable and no vibrations are sensed by the acceleration sensor 42.

With defined gravity vector V information for each region, the controller 50 can use the monitored gravity vector V of the acceleration sensor 42 to identify in which region(s) the acceleration sensor 42 located. For the example described above, this is outlined below:

The acceleration sensor 42 is located in region 1 if the gravity vector V is in the negative Y direction (right-side up) with an X offset of less than 2 degrees (either positive or negative).

The acceleration sensor 42 is located in either region 3 or region 5 if the gravity vector V is in the positive Y direction (upside down) with an X offset of less than 2 degrees (either positive or negative). The direction of travel of the passenger conveyor 10 (upwards or downwards) and previously determined region can be used to identify where the current location is in region 3 or 5. For example, if the passenger conveyor 10 is travelling upwards, and the previous location was 2, the current location is 3.

The acceleration sensor 42 is located in a mid-point of either region 2 or region 6 if the gravity vector V is in the X direction (either positive or negative). The direction of travel of the passenger conveyor 10 (upwards or downwards) and previously determined region can be used to identify where the current location is in region 2 or 6. Alternatively, the orientation of the acceleration sensor 42 can be used to distinguish between regions 2 and 6. Generally, when the acceleration sensor 42 is correctly oriented (as represented by FIGS. 4 and 5), the gravity vector V will be positive in the X direction in region 2.

The acceleration sensor 42 is located in region 4 if the gravity vector V is in the positive Y direction (upside down) with an X offset of more than 15 degrees (either positive or negative).

FIG. 6 shows an inclined passenger conveyor 10, represented in this figure as an escalator, which moves passengers along an inclined region 16 between a first landing region 12 and a second landing region 14. Balustrades 20 which each support a moving handrail 22 extend along each side of the passenger conveyor 10. A passenger conveyor monitoring system 40 includes an acceleration sensor 42 provided on the moving handrail 22, and a controller 50. The acceleration sensor 42 is mounted to an underside of the moving handrail in a suitable location.

Only one moving hand rail 22 is shown in FIG. 6. However, it will be appreciated that generally escalators 10 have two moving handrails 22 and an acceleration sensor 42 can be provided on each moving handrail 22.

It will also be appreciated that the moving handrail 22 with a monitoring system 40 as shown on an escalator in FIG. 6, could be also provided on an inclined moving walkway.

FIG. 7 shows a schematic representation of a closed loop path P of a moving handrail 22 of an inclined passenger conveyor 10, such as the escalator 10 of FIG. 6. In the closed loop path P of FIG. 7, eight regions are defined 1, 2, 3, 4, 5, 6, 7, 8. Orientation of the acceleration sensor 42 in each region 1, 2, 3, 4, 5, 6, 7, 8 is schematically represented by references 42-1, 42-2, 42-3, 42-4, 42-5, 42-6, 42-7 and 42-8.

FIG. 8 shows the acceleration due to gravity acting upon the acceleration sensor 42, i.e. gravity vector V (shown with a dashed line) in each region 1, 2, 3, 4, 5, 6, 7, 8 of the closed loop path P of FIG. 7. As the passenger conveyor 10 travels upwards, and the acceleration sensor 42 mounted to the moving handrail 22 moves in a clockwise direction around the closed loop path P. As the orientation of the acceleration sensor 42 varies, the acceleration due to gravity acting on the acceleration sensor 42, i.e. the gravity vector V (dashed lines) varies in the x, y and z axes. Variation of the gravity vector V within each region 1, 2, 3, 4, 5, 6, 7, 8 is represented with a dotted line.

In regions 1, 2 and 8, the moving handrail 22 is following a conveyance path Pc and its upper surface is facing upwards providing support for passengers, and the acceleration sensor 42-1, 42-2, 42-8 has its right side upwards so it detects a negative gravitational acceleration in the y direction. In regions 3 and 7, the moving handrail 22 moves around the upper turning point TU and the lower turning point TL and the gravity vector V changes with the changing orientation of the acceleration sensor 42-3, 42-7. In regions 4, 5 and 6 the moving handrail 22 is moving along its return path Pr. In region 4, the acceleration sensor 42-4 initially moves upside down and is then tilted as it moves up an inclined section to a turning point TM. In region 5, the acceleration sensor 42-5 is tilted as it moves down the inclined portion of the return path Pr. In region 6, the acceleration sensor 42-6 is upside down.

FIG. 9 shows a passenger conveyor 10, represented in this figure as moving walkway on which passengers are transported along a horizontal central region 16 between a first landing region 12 and a second landing region 14. The passenger conveyor 10 comprises a continuous series of escalator steps 26 in the form of pallets 26. Balustrades 20 which each support a moving handrail 22 extend along each side of the passenger conveyor 10. A passenger conveyor monitoring system 40 includes an acceleration sensor 42 provided on one of the escalator step 26, and a controller 50. The acceleration sensor 42 acts as a fault detection sensor 44.

FIG. 10 shows a schematic representation of a closed loop path P of FIG. 9. In the closed loop path P of FIG. 10, eight regions are defined 1, 2, 3, 4, 5, 6, 7, 8. Orientation of the acceleration sensor 42 in each region 1, 2, 3, 4, 5, 6, 7, 8 is schematically represented by references 42-1, 42-2, 42-3, 42-4, 42-5, 42-6, 42-7 and 42-8.

FIG. 11 shows acceleration due to gravity acting upon the acceleration sensor 42, i.e. the gravity vector V, in each region 1, 2, 3, 4, 5, 6, 7, 8 of the closed loop path P of FIG. 9. As the passenger conveyor 10 travels from left to right, the acceleration sensor 42, mounted to a escalator step 26, moves in a clockwise direction around the closed loop path P, starting in region 1 and moving through regions 2, 3, 4, 5, 6, 7, 8 and then back to region 1. As the acceleration sensor 42 moves along the closed loop path P, its orientation varies, the acceleration due to gravity acting on the acceleration sensor 42, i.e. the gravity vector V (dashed lines) varies in the x, y and z axes. Variation of the gravity vector V within each region 1, 2, 3, 4, 5, 6, 7, 8 is represented with a dotted line.

In region 1, the escalator steps 26 are following a conveyance path Pc, its upper surface is facing upwards providing support for passengers, and the acceleration sensor 42-1 has its right side upwards so it detects a negative gravitational acceleration in the y direction. In regions 2 and 8, the moving handrail 22 moves around a first turning point TU and a second turning point TL and the gravity vector V changes with the changing orientation of the acceleration sensor 42. At a mid-point in regions 2 and 8 (represented in FIG. 10), the acceleration sensor 42-2, 42-8 is rotated approximately ninety degrees.

In regions 3, 5 and 7 the moving handrail 22 is moving along its return path Pr and the acceleration sensor 42-3, 42-5, 42-7 is upside down. The previously determined region can be used to distinguish between regions 3, 5 and 6. Regions 4 and 6 can be identified due to the inclined travel of the acceleration sensor 42-4, 42-6.

FIG. 12 shows a schematic representation of an exemplary method of monitoring a passenger conveyor 10 with the monitoring system 40. The acceleration sensor 42 is mounted to a moveable component 22, 26, 20 of a passenger conveyor 10 as outlined above.

In step 200, the controller 50 determines the orientation of the acceleration sensor 42. The initial orientation of the acceleration sensor 42 is defined in order to interpret the data collected.

In step 300, the controller 50 determines a direction of travel of the acceleration sensor 42.

In step 400 the controller 50 determines a location region of the acceleration sensor 42.

The controller 50 monitors the location of the acceleration sensor 42 and when data is received which indicates a fault (step 500), the controller 50 determines in which region the indicated fault is located (step 510).

The fault data could be generated by the acceleration sensor 42 or by another fault detection sensor 44 located adjacent to the acceleration sensor 42.

The controller 50 can be configured to define the regions of the closed loop path P when an acceleration sensor 42 has been installed on a movable component 22, 26, 30 in a passenger conveyor 10. During the set-up process, the controller 50 monitors data relating to the gravity vector V and a start-up acceleration A. The controller 50 analyses the monitored data to establish patterns in order to define the different regions in the closed loop path P. Once the set-up is complete, the controller 50 monitors the current location in order to determine in which region the acceleration sensor 42 is located. The set-up process could be carried out in step 200 of the process described in FIG. 12.

The method steps of FIG. 12 are explained in more detail below.

The determination of the orientation of the acceleration sensor 42 can be achieved manually when the acceleration sensor 42 is installed in the passenger conveyor 10. For example, the acceleration sensor 42 could include markings to indicate the correct orientation to the maintenance engineer.

Alternatively, or additionally (i.e. as a system check), the monitoring system 40 can follow a self-orientation determination process.

FIG. 13 is a schematic representation of an exemplary orientation determination process 200 of the method of FIG. 12. The process 200 of FIG. 13 describes how the orientation of an acceleration sensor 42 moving in the closed loop path P shown in FIG. 2 can be determined. However, it will be appreciated that a self-orientation process can be defined for any closed loop path P.

First a check is made as to whether the acceleration sensor 42 is powered up. If the acceleration sensor is not powered up, then no action is required by the controller 50.

In step 210, the controller 50 determines whether the acceleration sensor 42 is mounted on the escalator step 26. This could be a manual operation carried out by the maintenance engineer. Alternatively or additionally (for example as a system check), data from the acceleration sensor 42 can be used to determine whether it is mounted. After power-up, the acceleration sensor 42 is determined not to be mounted if the detected motion is not consistent with recognised passenger conveyor 10 movement, meaning that the acceleration sensor 42 is probably being manually handled, for example if there is a significant gravity vector V in the z axis for longer than 50 msec, or it is in storage. It can be determined that the acceleration sensor 42 is mounted if the detected motion is consistent with recognised passenger conveyor 10 movement, for example if the gravity vector V is stationary for more than 30 seconds, then rotates in the same direction of the XY plane through a complete 360 degrees over a time period of greater than 30 seconds.

In step 220, the controller 50 determines whether the acceleration sensor 42 is in region 4. The acceleration sensor 42 is located in region 4 if the gravity vector V is in the positive y direction (upside down) with an x offset of more than 15 degrees (either positive or negative).

In step 230, the controller 50 analyses the gravity vector V component in the x-axis and sets the orientation accordingly in steps 240 and 250. In step 260, this is stored in the controller 50 until the acceleration sensor 42 is next powered up.

The determination of the direction of travel of the acceleration sensor 42 is achieved by the controller 50 monitoring both the gravity vector V and a start-up acceleration A of the acceleration sensor 42. This can be determined for any closed loop path P.

An example related to FIGS. 1 to 5 is explained below.

FIG. 14*a* shows the variation of acceleration due to gravity acting upon the acceleration sensor 42, i.e. the gravity vector V (dashed line) as the passenger conveyor 10 of FIGS. 1 and 2 moves upwards, and the acceleration sensor 42 moves in an clockwise direction around the closed loop path P. The start-up acceleration A in each region 1, 2, 3, 4, 5, 6 is represented with an arrow depicted on the gravity vector V.

FIG. 14*b* shows the variation of the gravity vector V and the start-up acceleration A as the passenger conveyor 10 of FIGS. 1 and 2 moves downwards, and the acceleration sensor 42 moves in an anti-clockwise direction around the closed loop path P.

FIG. 15 is a schematic representation of an exemplary process 300 for determining the direction of travel of the acceleration sensor 42 in the method of FIG. 12. The process 300 of FIG. 15 describes how the direction of travel of the acceleration sensor 42 moving in the closed loop path P shown in FIG. 2 can be determined. However, it will be appreciated that a process can be defined for any closed loop path P.

In step 310, the controller 50 determines whether the passenger conveyor 10 is in motion. This can be done by detecting recognised passenger conveyor 10 movement, for example it can be determined that the acceleration sensor 42 is in motion if there are vibrations greater than 5 milli-Gs in at least 2 axes.

If the acceleration sensor 42 is not in motion the controller 50 determines whether the acceleration sensor 42 is in regions 1, 3, or 5 (step 320). This determination is made by comparing the current gravity vector V to the known gravity vectors for each region. The acceleration sensor 42 is located in region 1 if the gravity vector V is in the negative Y direction (right-side up) with an X offset of less than 2 degrees (either positive or negative). The acceleration sensor 42 is located in either region 3 or region 5 if the gravity vector V is in the positive Y direction (upside down) with an X offset of less than 2 degrees (either positive or negative).

In step 320, if the acceleration sensor is not in region 1, 3 or 5, the controller continues to monitor for motion (step 310).

If the acceleration sensor is in region 1, 3 or 5, the controller 50 continues to monitor for motion (step 330) and once the acceleration sensor 42 starts to move, a determination of direction of travel can be made based on the orientation of the acceleration sensor 42 and whether the change in start-up acceleration A in the x direction is positive or negative (step 340).

In step 310, if the acceleration sensor 42 is in motion the controller 50 checks whether the direction is already known (step 350). If not, the controller 50 determines whether the acceleration sensor 42 is in regions 1, 3, or 5 (step 360) as outlined above. If the acceleration sensor 42 is in region 1, 3 or 5, the controller 50 determines a direction of travel based on the orientation of the acceleration sensor 42, the current direction of the gravity vector V and the previous direction of the gravity vector V (step 380).

If the acceleration sensor 42 is not in regions 1, 3 or 5 the controller 50 determines whether the acceleration sensor 42 is in region 2 or 6 (step 370). The mid-point of regions 2 and 6 can be identified as the gravity vector is in the positive or negative X direction. If yes, the controller 50 determines a direction of travel based on the orientation of the acceleration sensor 42 and whether the start-up acceleration A in the x direction is positive or negative (step 390).

If the acceleration sensor 42 is not in regions 2 or 6, the controller 50 checks again whether the acceleration sensor 42 is in regions 1, 3 or 5 (step 360).

Once the direction of travel is established, the determination of a current location region of the acceleration sensor 42 is achieved by the controller 50 monitoring the gravity vector V taking into account the direction of travel. This can be determined for any closed loop path P.

The controller 50 monitors the location of the acceleration sensor 42 and when data is received which indicates a fault, the controller 50 can determine in which region the indicated fault is located. The fault data could be generated by the acceleration sensor 42 or by another fault detection sensor located adjacent to the acceleration sensor 42.

An example related to FIGS. 1 to 5 is explained below.

FIG. 16 is a schematic representation of an exemplary process 400 for determining the location of the acceleration sensor 42 in the method of FIG. 12. The process 300 of FIG. 15 describes how the direction of travel of the acceleration sensor 42 moving in the closed loop path P shown in FIG. 2 can be determined. However, it will be appreciated that a process can be defined for any closed loop path P.

In step 410, the controller 50 determines whether the gravity vector V is entirely in the y-axis, and if yes in step 440 the controller 50 checks the direction of the gravity vector V. When the gravity vector V is negative in the y-axis, the controller 50 determines that the acceleration sensor 42 is in region 1 (step 445).

If the determination from step 440 is no, the controller 50 checks the determined direction of travel (step 450). If the direction is up, the controller 50 checks the previous location region to determine whether the current location region is 2 or 4 (step 455). If the direction is down, the controller 50 checks the previous location region to determine whether the current location region is 4 or 6 (step 460).

If the determination in step 410 is no, then the controller 50 determines whether the gravity vector V is entirely in the x-axis (step 420). If yes, in step 470 the controller 50 checks the direction of the gravity vector V. If the gravity vector is negative in the x-axis, the controller 50 checks the orientation to determine whether the current location is in region 2 or 6 (step 475). If the gravity vector V is positive in the x-axis, the controller 50 checks the orientation to determine whether the current location is in region 2 or 6 (step 480). If the orientation of the acceleration sensor 42 is known, then it is be possible to determine whether the current location is 2 or 6 based on the direction of the gravity vector V, i.e. in region 2 it will be in the positive x direction.

If the determination in step 420 is no, the controller 50 determines if the gravity vector V is mostly in the positive y axis but also in the x direction (step 430). If yes, the controller 50 determines that the location is in region 4 (step 490). If no, then the controller 50 repeats step 410.

Whilst the examples described above relate to specific components of passenger conveyors, it will be appreciated that the monitoring system 40 and monitoring method 400 described can be used on any component in a passenger conveyor 10 which moves in a defined closed loop path P.

While the disclosure has been described in detail in connection with only a limited number of examples, it should be readily understood that the disclosure is not limited to such disclosed examples. Rather, the disclosure can be modified to incorporate any number of variations, alterations, substitutions or equivalent arrangements not heretofore described, but which are commensurate with the scope of the disclosure. Additionally, while various examples of the disclosure have been described, it is to be understood that aspects of the disclosure may include only some of the described examples. Accordingly, the disclosure is not to be seen as limited by the foregoing description, but is only limited by the scope of the appended claims.

What is claimed is:

1. A monitoring system (40) for a passenger conveyor (10) comprising at least one acceleration sensor (42) provided on a movable component (22, 26, 30) of the passenger conveyor (10), wherein the moveable component (22, 26, 30) moves in a closed loop path (P) when the passenger conveyor (10) is in use;

a fault detection sensor (44) associated with the or each acceleration sensor (42) and configured to provide data indicative of a fault in the moveable component (22, 26, 30); and a controller (50) configured to:

receive data from the or each acceleration sensor (42);

monitor a gravity vector (V) of the or each acceleration sensor (42);

determine a direction of travel of the or each acceleration sensor (42);

determine a current location of the or each acceleration sensor (42) based on the monitored gravity vector (V) and the determined direction of travel;

detect a fault from the data received from the or each fault detection sensor (44);

identify a location of the detected fault based on the determined current location of the associated acceleration sensor (42);

wherein the controller (50) is further configured to determine an orientation of the or each acceleration sensor (42) after power up of the acceleration sensor (42).

2. The monitoring system (40) according to claim 1, wherein the controller (50) is configured to determine the current location of the acceleration sensor (42) in relation to a plurality of predefined regions of the closed loop path (P).

3. The monitoring system (40) of claim 1, wherein at least one acceleration sensor (42) acts as the associated fault detection sensor (44).

4. The monitoring system (40) of claim 1, wherein at least one fault detection sensor (44) is provided adjacent to the associated acceleration sensor (42).

5. The monitoring system (40) of claim 1, wherein the controller (50) is further configured to monitor a start-up acceleration (A) of the or each acceleration sensor (42)

and determine the direction of travel of the or each acceleration sensor (42) based on the monitored start-up acceleration (A) and the monitored gravity vector (V).

6. The monitoring system (40) of claim 1, further comprising a control station (52) located remotely from the passenger conveyor (10).

7. A passenger conveyor (10) comprising a monitoring system (40) according to claim 1.

8. The passenger conveyor (10) according to claim 7, wherein the passenger conveyor (10) is an escalator and the moveable component is an escalator step (26).

9. A method (100) of monitoring a passenger conveyor (10), comprising:

receiving data from an acceleration sensor (42) provided on a moveable component (22, 26, 30) of the passenger conveyor (10);

monitoring a gravity vector (V) of the acceleration sensor (42);

determining a direction of travel of the acceleration sensor (42);

determining a current location of the acceleration sensor (42) based on the monitored gravity vector (V) and the determined direction of travel;

receiving data indicative of a fault in the moveable component (22, 26, 30);

detecting a fault from the data received from the fault detection sensor (44);

identifying a location of the detected fault based on the determined current location of the acceleration sensor (42);

the method further including determining an orientation of the acceleration sensor (42) after power up of the acceleration sensor (42).

10. The method (100) according to claim 9, wherein the step of identifying a location of the detected fault includes determining the current location in relation to a plurality of predefined regions of the closed loop path (P).

11. The method (100) according to claim 9, wherein the step of receiving data indicative of a fault in the moveable component (22, 26, 30) includes receiving data from the acceleration sensor (42).

12. The method (100) according to claim 9, wherein the step of determining a direction of travel of the acceleration sensor (42) includes:

monitoring a start-up acceleration (A) of the acceleration sensor (42); and determining the direction of travel based on the determined monitored start-up acceleration (A) and the monitored gravity vector (V).

13. The method (100) according to claim 9, further comprising transmitting data to a control station (52) located remotely from the passenger conveyor (10).

* * * * *